US005914911A

United States Patent [19]

Babour et al.

[11] Patent Number: 5,914,911

[45] **Date of Patent: *Jun. 22, 1999**

[54] METHOD OF RECOVERING DATA ACQUIRED AND STORED DOWN A WELL, BY AN ACOUSTIC PATH, AND APPARATUS FOR IMPLEMENTING THE METHOD

[75] Inventors: Kamal Babour, Bures sur Yvette; Dennis J. Pittman, Sorbiers; Christian B. Huau, Fontenay Aux Roses, all of France

[73] Assignee: Schlumberger Technology Corporation, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/740,942

[22] Filed: Nov. 5, 1996

[30] Foreign Application Priority Data

Nov. 7, 1995 [FR] France ..... 95 13145

[51] Int. Cl.[6] ..... G01V 1/40; E21B 47/12

[52] U.S. Cl. ..... 367/82; 367/81; 340/853.7; 340/854.4; 340/854.9

[58] Field of Search ..... 367/81, 82; 340/853.1, 340/853.7, 854.4, 854.6, 854.9, 855.7, 853.3; 166/65.1

[56] References Cited

U.S. PATENT DOCUMENTS

| | | | |
|---|---|---|---|
| 2,370,818 | 3/1945 | Silverman | 340/853.3 |
| 3,209,323 | 9/1965 | Grossman, Jr. | 340/853.3 |
| 4,770,034 | 9/1988 | Titchener et al. | 340/854.3 |
| 4,992,997 | 2/1991 | Bseisu . | |
| 5,160,925 | 11/1992 | Dailey et al. | 340/853.3 |
| 5,278,550 | 1/1994 | Rhein-Knudsen et al. | 340/855.1 |
| 5,410,303 | 4/1995 | Comeau et al. | 340/853.3 |
| 5,602,541 | 2/1997 | Comeau et al. | 340/853.3 |

FOREIGN PATENT DOCUMENTS

| | | |
|---|---|---|
| 0 636 763 A2 | 7/1994 | European Pat. Off. . |
| WO 92/02054 | 2/1992 | WIPO . |
| WO 92/06278 | 4/1992 | WIPO . |

*Primary Examiner*—Ian J. Lobo

*Attorney, Agent, or Firm*—John J. Ryberg; Brigitte L. Jeffery

[57] ABSTRACT

In a well (10) in production or undergoing tests, the recovery of data acquired and stored in a downhole unit (16) located in the lower part of a drillpipe string (12) below a test valve (20) is effected directly in the form of acoustic signals between the downhole unit (16) and an interface tool (24). To this end, acoustic coupling is established between the tool (24) and the drillpipe string (12), and electro-acoustic transducers are provided in the tool and in the downhole unit (16). Commands are transmitted in the opposite direction, also in the form of acoustic signals, in particular to initiate data recovery. The transmission of data and commands between the tool (24) and the surface unit (22) is effected by any known means, for example in the form of electrical signals carried by a cable (26).

40 Claims, 2 Drawing Sheets

METHOD OF RECOVERING DATA ACQUIRED AND STORED DOWN A WELL, BY AN ACOUSTIC PATH, AND APPARATUS FOR IMPLEMENTING THE METHOD

TECHNICAL FIELD

This invention relates to a method of recovering data acquired and stored in a downhole unit located below an obstruction, in the lower part of a drillpipe string disposed in a well, such as an oil well under test or in production.

The invention also relates to apparatus for implementing this method.

STATE OF THE ART

When an oil well is under test before being put into service, measurements are made, such as pressure measurements down the well, with the aid of a downhole unit located in the lower part of a drillpipe string received within the well. This downhole unit is normally placed below a valve fitted in the drillpipe string in such a manner as to allow alternate opening and closing of the passage formed in the drillpipe string.

The development of the reservoir can also be monitored periodically when the well is in production, by means of apparatus like that used during tests.

In both cases the measurements are effected down the well by means of sensors, such as pressure sensors forming part of the downhole unit and they are stored in this unit. Recovery at the surface of data thus acquired is effected later, when the measurement campaign has been completed.

More specifically, according to that conventional technique, the recovery of data at the surface is normally effected by means of equipment which is lowered to the level of the downhole unit to recover the data stored in the unit. That data recovery technique prevents the tooling being lowered before the measurement campaign has been finished, since performance of the measurements is accompanied by the intermittent closing of the valve disposed above the downhole unit in the lower part of the drillpipe string.

That conventional technique does not pose any particular problems so far as the recovery of data at the surface is concerned. However, it is a disadvantage to postpone exploitation of the measurements until the end of the measurement campaign. It is thus completely impossible to intervene on measurement acquisition parameters or even to interrupt the measurements if it appears that the results justify this. This leads in turn to a loss of time and money which is sometimes large when the measurements cannot be used for one reason or another and a new measurement campaign is necessary.

In order to deal with this problem it appears desirable to be able to transmit the data acquired by the sensors of the downhole unit in spite of the presence of the valve. It also appears to be desirable to be able to operate on the downhole unit during the measurements, particularly in order to be able to vary its data acquisition parameters.

As is shown in particular by U.S. Pat. No. 4,992,997, use of the drillpipe string has been contemplated to transmit the data between a downhole unit and a surface unit, in the form of acoustic signals. However, up to the present, that technique has not been able to provide industrially exploitable results, in particular because the drillpipe string is built up from pipe sections that are connected together by joints which create echoes.

It is proposed in the document WO-A 92 06278 to insert an intermediate unit in the drillpipe string, located above the valve. The data acquired in the downhole unit is transmitted to the intermediate unit as it is acquired, in order to be stored. The transmission of data between the downhole unit and the intermediate unit is effected in the form of acoustic signals. When it is desired to recover the data at the surface, a tool suspended on a cable is lowered inside the drillpipe string to the level of the intermediate unit. The transmission of data between the intermediate unit and the tool is effected by inductive coupling. The data is then recovered at the surface unit in the form of electrical signals passing along the cable on which the tool is suspended.

Compared with the method which is normally used, that method allows data to be recovered without waiting for the end of the measurement campaign. However it suffers from the disadvantage of requiring the addition of a supplementary intermediate unit in the drillpipe string and the presence of inductive coupling means between this unit and the tool, which results in an appreciable increase in the cost compared with conventional apparatus.

Moreover, the intermediate unit comprises numerous parts (acoustic transducer, filter, inductive winding, rechargeable battery, electronic module, etc.), which lead to substantial size in the height direction. The transmission of data in the form of acoustic signals between the downhole unit and this intermediate unit is thus effected over a relatively great length of the drillpipe string, which requires complex signal processing.

Finally, the signal processing recommended in the intermediate unit imposes constraints on size which are difficult to satisfy, taking into account both the small thickness of the drillpipe string and the complexity of the processing to be effected.

SUMMARY OF THE INVENTION

According to the invention there is provided a method of recovering data acquired and stored in a downhole unit located below an obstruction, in the lower part of a drillpipe string disposed in a well, characterized in that the method comprises the following steps:

- positioning an interface tool in the drillpipe string, above the obstruction, in such a way as to ensure acoustic coupling of the tool with the drillpipe string; and
- transmitting data previously stored in the downhole unit directly from the unit to the interface tool, in the form of acoustic signals travelling in the drillpipe string.

The invention thus defined can ensure data recovery without waiting for the end of a measurement campaign and without the need for an additional intermediate unit in the drillpipe string. It also avoids the need for inductive coupling means between the drillpipe string and the tool. Furthermore, the distance data is transmitted along the drillpipe string in the form of acoustic signals can be reduced to a minimum value and the data is processed at the surface.

The positioning of the interface tool is advantageously also followed by sending commands to the downhole unit, transmitted directly from the tool to the unit in the form of acoustic signals, the commands comprising a start-of-transmission command which initiates data transmission.

In a preferred embodiment of the invention, the transmission of data to the interface tool, in the form of acoustic signals, is followed by the following steps:

- transformation of the acoustic signals into non-acoustic signals in the interface tool; and
- transmission of data from the interface tool to a surface unit in the form of non-acoustic signals.

An interface tool is then preferably used which is connected to a surface unit by a cable, in which the data is transmitted in the form of electrical signals.

In a variant, the data can also be transmitted between the interface tool and a surface unit in the form of electromagnetic signals.

In another embodiment of the invention, the data is recorded in the interface tool and the tool is recovered at the surface in order to make use of the data.

The invention also provides apparatus for recovering data acquired and stored in a downhole unit located below an obstruction in the lower part of a drillpipe string in a well, characterized in that the apparatus comprises:

an interface tool adapted to be positioned in the drillpipe string above the obstruction and comprising acoustic coupling means for coupling the tool to the drillpipe string; and means for directly transmitting data stored in the downhole unit, from the unit to the interface tool in the form of acoustic signals.

BRIEF DESCRIPTION OF THE DRAWINGS

Various embodiments of the invention are described below by way of non-limiting example, with reference to the accompanying drawings, in which.

DETAILED DESCRIPTION OF PREFERRED EMBODIMENTS

Figure 1:
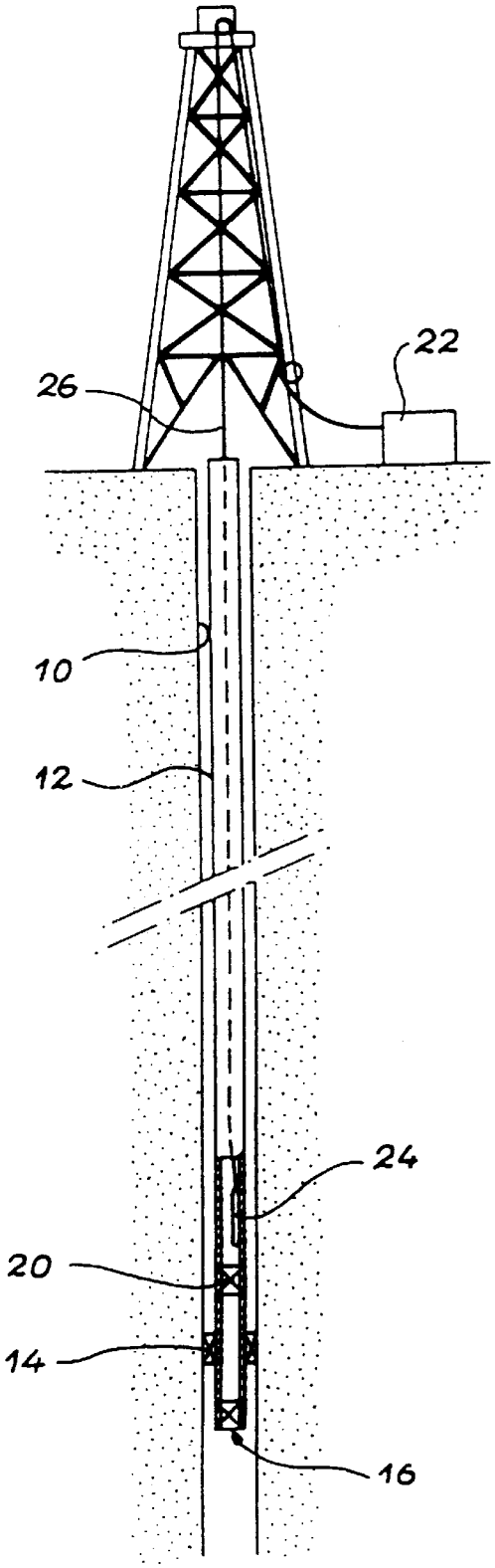
FIG. 1 is a partial longitudinal section which is a highly schematic representation of a well undergoing tests and equipped with apparatus for recovering data constituting a first embodiment of the invention.

An oil well 10 being drilled and undergoing tests is shown in a very schematic way in FIG. 1. The well 10 is equipped with a test apparatus allowing the characteristics of the reservoir to be evaluated.

The test apparatus comprises in particular a drillpipe string 12 which extend into the well from the surface down to a level near that of the reservoir (not shown) whose characteristics are sought. An annular sealing sleeve 14 blocks the annular space formed between the well 10 and the drillpipe string 12 near to the lower end of this drillpipe string.

Figure 2:
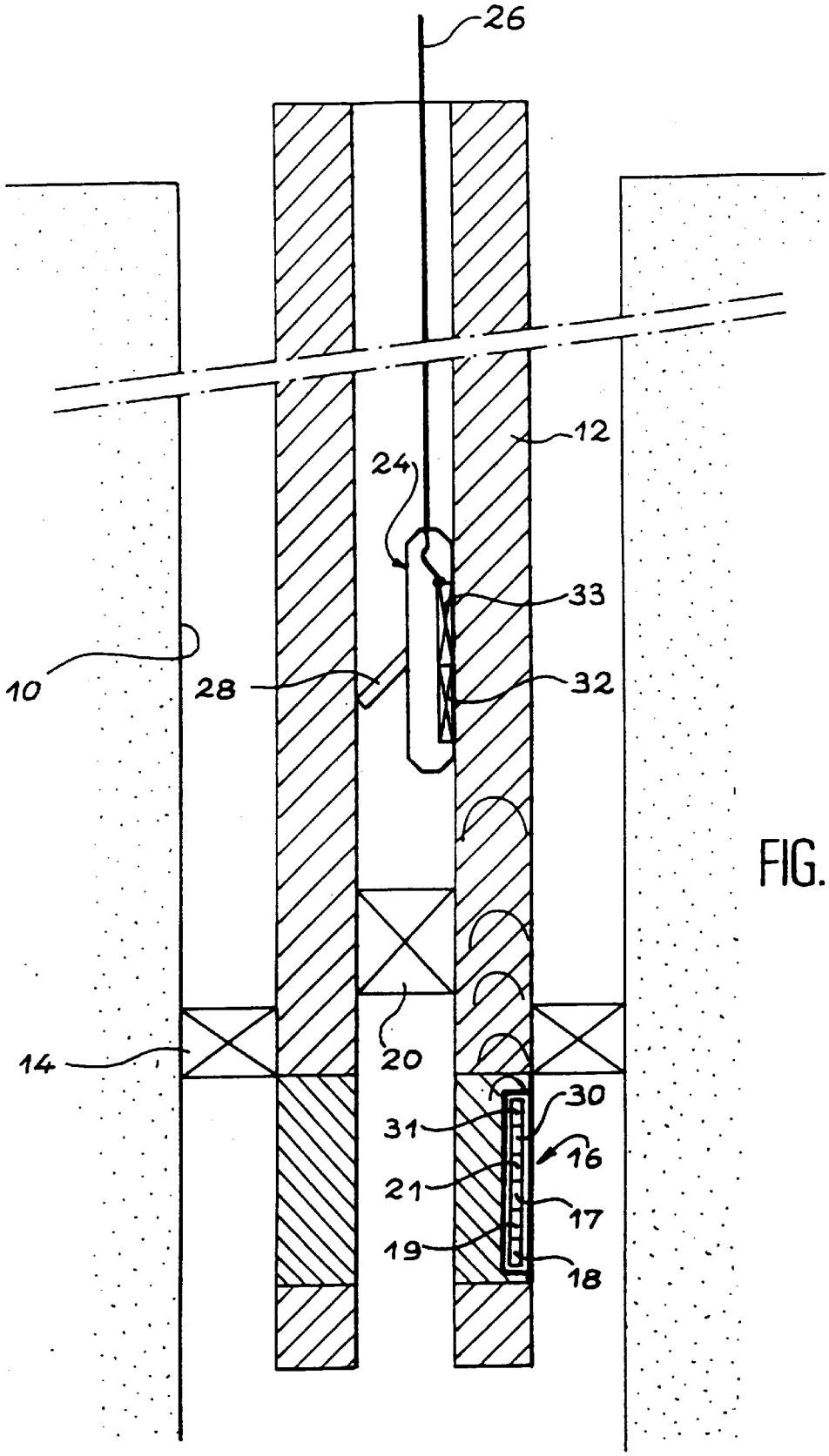
FIG. 2 is a sectional view in more detail of the part of the apparatus of FIG. 1 located down the well.

The test apparatus proper comprises a downhole unit 16 integrated into the drillpipe string 12 at its lower end. This downhole unit 16 can either be located below the sealing sleeve 14, as shown in FIGS. 1 and 2, or just above the sleeve. In the latter case, passages connect the inside of the drillpipe string 12 to the downhole unit 16, so that the measurements made with the unit are representative of the physical characteristics of the reservoir below the sleeve 14.

The downhole unit 16 comprises in particular at least one sensor, such as a pressure sensor 18, as shown in more detail in FIG. 2. The sensor 18 is equipped with a recording memory 19 in which the data acquired by the sensor is stored.

The downhole unit 16 also comprises a rechargeable battery 17 serving in particular to supply power to the sensor 18. It also comprises a control circuit 21 serving in particular to control data acquisition and storage in accordance with predetermined parameters. The test apparatus also comprises a test valve 20 located in the lower part of the drillpipe string 12, above the sealing sleeve 14 and the downhole unit 16. This test valve 20 is so disposed in the drillpipe string 12 as to allow the passage which extends along its entire length to be blocked. The valve 20 is closed intermittently during a measurement campaign, in order to allow the sensor 18 to measure the increase in pressure which occurs when the valve is opened.

The test apparatus also comprises a surface unit 22, in which the data acquired by the sensor 18 of the downhole unit 16 and stored in the recorder 19 is subsequently processed, interpreted and stored, once it has been recovered.

In conformity with the invention, a recovery apparatus for the data acquired and stored in the downhole unit 16 is added to the conventional test apparatus as described above. This data recovery apparatus comprises an interface tool 24 provided for positioning in the lower part of the drillpipe string, directly above the test valve 20. This interface tool 24 is provided with acoustic coupling means, whose operation ensures acoustic coupling between the tool and the drillpipe string 12.

In the embodiment shown in FIGS. 1 and 2, the interface tool 24 is suspended on a cable 26 whose opposite end is connected to the surface unit 22. The cable 26 then ensures data transmission between the tool 24 and the surface unit 22 in the form of electrical signals.

In this first embodiment of the invention, the acoustic coupling between the interface tool 24 and the drillpipe string 12 can be effected in particular by a mechanism which provides coupling through friction. This mechanism comprises, for example, pads 28 which are hinged on the tool 24 and which are deployed and retracted under the control of screws. When the pads 28 are deployed as shown in FIG. 2, they make contact with the inside surface of the drillpipe string 12 and thus press the interface tool 24 firmly against this surface. Good acoustic coupling is thus obtained.

The data transmission apparatus of the invention further comprises means for directly transmitting the data acquired and stored in the downhole unit 16 to the interface tool 24, in the form of acoustic signals. These transmission means also allow direct transmission of commands originating from the interface tool 24 to the downhole unit 16, likewise in the form of acoustic signals.

These transmission means comprise electro-acoustic transducer systems 30 and 32 in the downhole unit 16 and in the interface tool 24 respectively for converting electrical signals into acoustic signals and vice versa. These transducer systems can in particular be of piezoelectric, magnetostrictive or other type. Electronic circuits 31 and 33 are associated with the transducer systems 30 and 32 respectively.

By virtue of the acoustic coupling between the interface tool 24 and the drillpipe string 12 and of the provision of the electro-acoustic transducer systems 30, 32 in the downhole unit 16 and in the interface tool 24, the data acquired and stored in the downhole unit can be transmitted from the downhole unit to the tool, and the commands for the downhole unit can be transmitted from the tool to the downhole unit, in both cases in the form of acoustic signals travelling in the drillpipe string 12.

When the interface tool 24 has not yet been lowered into the drillpipe string 12, the transducer system 30 of the downhole unit is in a wait state.

When the interface tool 24 has been inserted into the drillpipe string above the valve 20, and then coupled acoustically to the drillpipe string by deployment of the pads 28, a start-to-transmit command is sent from the surface unit 22 or the tool 24. This command is transmitted directly from the interface tool to the downhole unit 16, in the form of an acoustic signal travelling in the drillpipe string. Its effect is to activate the transducer system 30 of the downhole unit. The data previously entered in the memory 19 of the downhole unit 16 are then transmitted directly to the electronic circuit 33 of the tool 24, again in the form of acoustic signals travelling in the drillpipe string.

It should be noted that the same mode of acoustic transmission can be used to transmit any command from the tool 24 to the control circuit 21 of the downhole unit 16, especially to clear the recording memory 19 or to modify the acquisition parameters and/or to enter data in memory.

Given that the interface tool 24 is itself connected to the surface unit 22 by the cable 26 in the embodiment of FIGS. 1 and 2, the data acquired by the sensor 18 and stored in the downhole unit 16 can be transmitted to the surface unit 22 without waiting for the end of a test campaign. The interpretation of the measurements made in the surface unit 22 makes it possible either to interrupt the tests, if an anomaly is found, or to alter in real time the acquisition or storage parameters in the downhole unit 16, by transmitting commands for this purpose from the surface unit 22 to the downhole unit 16, in the form of electrical signals in the cable 26 and then in the form of acoustic signals between the interface tool 24 and the downhole unit.

The data recovery apparatus of the invention thus allows the duration and cost of tests to be reduced substantially, without any need to add a unit to the drillpipe string.

The embodiment of the data recovery apparatus described above with reference to FIGS. 1 and 2 should not be considered as limiting. Thus the apparatus of the invention can be used equally well in a well undergoing tests or in a well in production, and the acoustic coupling means of the interface tool 24 and the drillpipe string 12 as well as the data and command transmission means between the tool and the surface unit 22 can differ from those which have been described.

Thus the frictional acoustic coupling mechanism described above with reference to FIGS. 1 and 2 can be replaced by a bolt mechanism cooperating with a recess provided therefor inside the drillpipe string 12 just above the valve 20.

Figure 3:
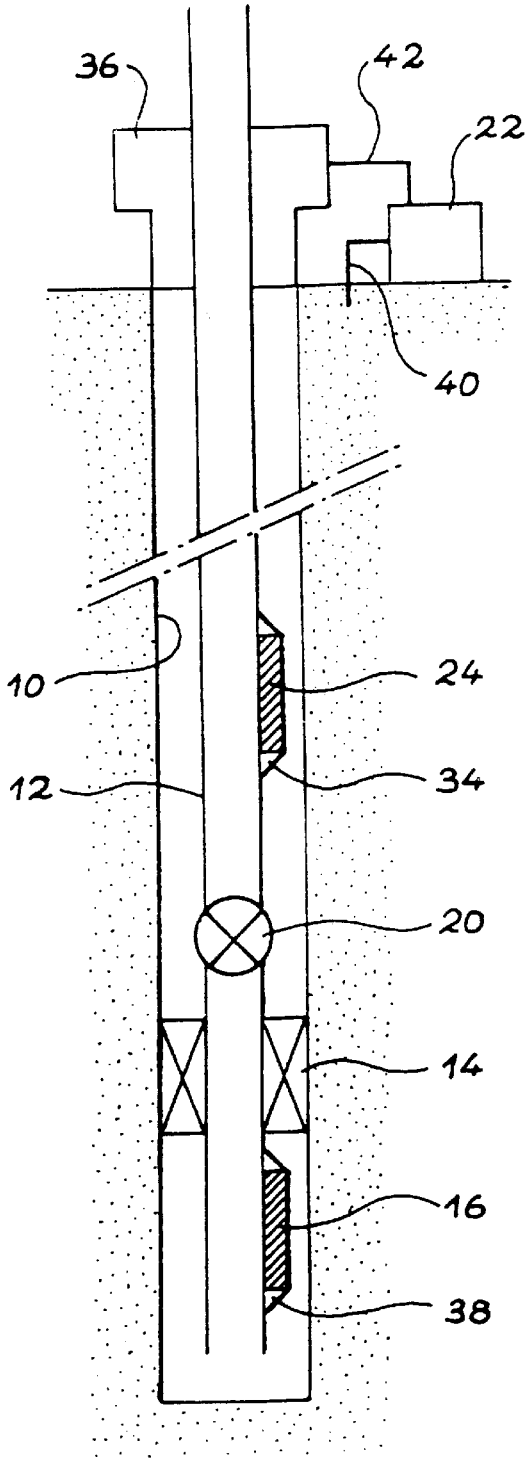
FIG. 3 is a schematic partial section like FIG. 1, illustrating another embodiment of the apparatus of the invention for recovering data.

As illustrated schematically in FIG. 3, it is also possible to receive the interface tool 24 in a pocket 34 formed on one side in the thickness of the drillpipe string 12, immediately above the valve 20.

FIG. 3 also shows the case in which the data recovery apparatus of the invention is used in a production well. In this case, the test apparatus described above with reference to FIGS. 1 and 2 is replaced by production apparatus with substantially the same characteristics. Thus the production apparatus likewise comprises a drillpipe string 12, a sealing sleeve 14, a downhole unit 16, and a valve 20. However, it differs from the test apparatus in that the annular space formed in the well 10 around the drillpipe string 12 is blocked at ground level by a well head 36. It also differs from the test apparatus in that the downhole unit 16 is also received in a side pocket 38 formed in the drillpipe string 12, below the sealing sleeve 14.

Although the transmission of data and commands between the interface tool 24 and the surface unit 22 can be effected in a production well in the manner described above with reference to FIGS. 1 and 2, i.e. in the form of electrical signals travelling in a cable, FIG. 3 also shows another mode of transmission of data and commands between the tool 24 and the surface unit 22.

This mode of transmission of data and commands consists in electromagnetic transmission. To this end the surface unit 22 is connected to the ground by an electrical conductor 40 and to the well head 36 by an electrical conductor 42. The data to be transmitted from the tool 24 to the surface unit 22 and the commands to be transmitted in the opposite direction are emitted in the form of electromagnetic signals, and they travel as electricity flowing in the drillpipe string 12 and in the well head 36.

It should be noted that this technique of transmitting data and commands in the form of electromagnetic signals between the interface tool and the surface unit 22 can also be used in a well undergoing tests.

In the case of a production well, when the tool 24 is designed to be received in a side pocket 34 of the drillpipe string 12, the recovery of the data picked-up by the tool can also be effected by equipping the tool with a memory, which is read out after the tool has been recovered at the surface. To effect such recovery a line like a piano wire can be used in particular, which provides a mechanical connection function only.

We claim:

1. A method of recovering data acquired and stored in a downhole unit (16) located below an obstruction (20), in the lower part of a drillpipe string (12) disposed in a well (10), comprising the steps of:

a. retrievably positioning a deployable interface tool (24) in the drillpipe string (12), above the obstruction (20), in such a way as to ensure acoustic coupling of the tool with the drillpipe string; and b. transmitting data previously stored in the downhole unit (16) directly from the unit to the interface tool (24), in the form of acoustic signals traveling in the drillpipe string (12).

2. The method according to claim 1, wherein the positioning of the interface tool (24) is also followed by sending commands to the downhole unit, transmitted directly from the tool to the unit in the form of acoustic signals, the commands comprising a start-of-transmission command which initiates the data transmission.

3. The method according to claim 1, wherein the transmission of data to the interface tool (24), in the form of acoustic signals, is followed by the following steps:

c. transformation of the acoustic signals into non-acoustic signals in the interface tool (24); and d. transmission of data from the interface tool (24) to a surface unit (22) in the form of non-acoustic signals.

4. The method according to claim 2, wherein the transmission of data to the interface tool (24), in the form of acoustic signals, is followed by the following steps:

c. transformation of the acoustic signals into non-acoustic signals in the interface tool (24); and d. transmission of data from the interface tool (24) to a surface unit (22) in the form of non-acoustic signals.

5. The method according to claim 3, wherein an interface tool (24) is used which is connected to a surface unit (22) by a cable (26) through which the data is transmitted in the form of electrical signals.

6. The method according to claim 4, wherein an interface tool (24) is used which is connected to a surface unit (22) by a cable (26) through which the data is transmitted in the form of electrical signals.

7. The method according to claim 3, wherein the data is transmitted between the interface tool (24) and a surface unit (22) in the form of electromagnetic signals.

8. The method according to claim 4, wherein the data is transmitted between the interface tool (24) and a surface unit (22) in the form of electromagnetic signals.

9. The method according to claim 1, wherein the data is recorded in the interface tool (24) and the tool is recovered at the surface in order to make use of the data.

10. The method according to claim 2, wherein the data is recorded in the interface tool (24) and the tool is recovered at the surface in order to make use of the data.

11. The method according to claim 3, wherein the data is recorded in the interface tool (24) and the tool is recovered at the surface in order to make use of the data.

12. Apparatus for recovering data acquired and stored in a downhole unit (16) located below an obstruction (20) in the lower part of a drillpipe string (12) in a well (10), comprising:

a. a deployable interface tool (24) adapted to be retrievable positioned in the drillpipe string (12) above the obstruction (20) and comprising acoustic coupling means (28) for coupling the tool to the drillpipe string; and means (30, 32) for directly transmitting data stored in the downhole unit (16), from the unit to the interface tool (24) in the form of acoustic signals traveling in the drillpipe string (12).

13. Apparatus according to claim 12, wherein the transmission means (30, 32) also allow commands for the downhole unit (16) to be transmitted directly from the interface tool (24) to the unit, in the form of acoustic signals.

14. Apparatus according to claim 12, wherein the interface tool (24) comprises means (32) for converting the acoustic signals into non-acoustic signals and further comprises means (26) for transmitting data between the interface tool (24) and a surface unit (22) in the form of non-acoustic signals.

15. Apparatus according to claim 13, wherein the interface tool (24) comprises means (32) for converting the acoustic signals into non-acoustic signals and further comprises means (26) for transmitting data between the interface tool (24) and a surface unit (22) in the form of non-acoustic signals.

16. Apparatus according to claim 14 wherein the non-acoustic signals are adapted to travel along a cable (26) connecting the surface unit (22) to the interface tool.

17. Apparatus according to claim 15 wherein the non-acoustic signals are adapted to travel along a cable (26) connecting the surface unit (22) to the interface tool.

18. Apparatus according to claim 14 wherein the non-acoustic signals are electromagnetic signals adapted to travel along the drillpipe string (12).

19. Apparatus according to claim 15 wherein the non-acoustic signals are electromagnetic signals adapted to travel along the drillpipe string (12).

20. Apparatus according to claim 13 wherein the interface tool (24) comprises means for recording data, adapted to be made use of after recovery of the tool.

21. A method of recovering data acquired and stored in a downhole unit (16) located below a valve (20), in the lower part of a drillpipe string (12) sealingly secured in a well (10), said valve forming an obstruction in said string, comprising the steps of:

retrievably positioning a deployable interface tool (24) in the drillpipe string (12), above the valve (20), in such a way as to ensure acoustic coupling of the tool with the drillpipe string; and transmitting data previously stored in the downhole unit (16) directly from the unit to the interface tool (24), in the form of acoustic signals travelling in the drillpipe string (12).

22. A method according to claim 21, wherein the positioning of the interface tool (24) is also followed by sending commands to the downhole unit, transmitted directly from the tool to the unit in the form of acoustic signals, the commands comprising a start-of-transmission command which initiates the data transmission.

23. A method according to claim 21, wherein the transmission of data to the interface tool (24), in the form of acoustic signals, is followed by the following steps:

transformation of the acoustic signals into non-acoustic signals in the interface tool (24); and transmission of data from the interface tool (24) to a surface unit (22) in the form of non-acoustic signals.

24. A method according to claim 22, wherein the transmission of data to the interface tool (24), in the form of acoustic signals, is followed by the following steps:

transformation of the acoustic signals into non-acoustic signals in the interface tool (24); and transmission of data from the interface tool (24) to a surface unit (22) in the form of non-acoustic signals.

25. A method according to claim 23, wherein an interface tool (24) is used which is connected to a surface unit (22) by a cable (26) through which the data is transmitted in the form of electrical signals.

26. A method according to claim 24, wherein an interface tool (24) is used which is connected to a surface unit (22) by a cable (26) through which the data is transmitted in the form of electrical signals.

27. A method according to claim 23, wherein the data is transmitted between the interface tool (24) and a surface unit (22) in the form of electromagnetic signals.

28. A method according to claim 24, wherein the data is transmitted between the interface tool (24) and a surface unit (22) in the form of electromagnetic signals.

29. A method according to claim 21, wherein the data is recorded in the interface tool (24) and the tool is recovered at the surface in order to make use of the data.

30. A method according to claim 22, wherein the data is recorded in the interface tool (24) and the tool is recovered at the surface in order to make use of the data.

31. A method according to claim 23, wherein the data is recorded in the interface tool (24) and the tool is recovered at the surface in order to make use of the data.

32. Apparatus for recovering data acquired and stored in a downhole unit (16) located below a valve (20), in the lower part of a drillpipe string (12) sealingly secured in a well (10), said valve forming an obstruction in said string, comprising:

an interface tool (24) adapted to be positioned in the drillpipe string (12) above the valve (20) and comprising acoustic coupling means (28) for coupling the tool to the drillpipe string; and means (30, 32) for directly transmitting data stored in the downhole unit (16), from the unit to the interface tool (24) in the form of acoustic signals.

33. Apparatus according to claim 32, wherein the transmission means (30, 32) also allow commands for the downhole unit (16) to be transmitted directly from the interface tool (24) to the unit, in the form of acoustic signals.

34. Apparatus according to claim 32, wherein the interface tool (24) comprises means (32) for converting the acoustic signals into non-acoustic signals and in that it further comprises means (26) for transmitting data between the interface tool (24) and a surface unit (22) in the form of non-acoustic signals.

35. Apparatus according to claim 33, wherein the interface tool (24) comprises means (32) for converting the acoustic signals into non-acoustic signals and in that it further comprises means (26) for transmitting data between the interface tool (24) and a surface unit (22) in the form of non-acoustic signals.

36. Apparatus according to claim 34, wherein the non-acoustic signals are adapted to travel along a cable (26) connecting the surface unit (22) to the interface tool.

37. Apparatus according to claim 35, wherein the non-acoustic signals are adapted to travel along a cable (26) connecting the surface unit (22) to the interface tool.

38. Apparatus according to claim 34, wherein the non-acoustic signals are electromagnetic signals adapted to travel along the drillpipe string (12).

39. Apparatus according to claim 35, wherein the non-acoustic signals are electromagnetic signals adapted to travel along the drillpipe string (12).

40. Apparatus according to claim 33, wherein the interface tool (24) comprises means for recording data, adapted to be made use of after recovery of the tool.

* * * * *